US008845404B2

(12) United States Patent
Bash et al.

(10) Patent No.: US 8,845,404 B2
(45) Date of Patent: Sep. 30, 2014

(54) VENTILATION TILE WITH COLLAPSIBLE DAMPER

(75) Inventors: Cullen E. Bash, Los Gatos, CA (US); David Allen Moore, Tomball, TX (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 2156 days.

(21) Appl. No.: 11/353,557

(22) Filed: Feb. 14, 2006

(65) Prior Publication Data

US 2007/0190927 A1 Aug. 16, 2007

(51) Int. Cl.

| | |
|---|---|
| ***B01L 1/04*** | (2006.01) |
| ***E21F 1/00*** | (2006.01) |
| ***F24F 13/10*** | (2006.01) |
| ***F24F 11/00*** | (2006.01) |

(52) U.S. Cl.

CPC ..... *F24F 13/105* (2013.01); *F24F 11/0001* (2013.01)

USPC ..... 454/187; 454/167

(58) Field of Classification Search

USPC ..... 454/167

See application file for complete search history.

(56) References Cited

U.S. PATENT DOCUMENTS

| | | | | |
|---|---|---|---|---|
| 4,188,862 | A | 2/1980 | Douglas, III | |
| 5,145,456 | A | 9/1992 | Ito et al. | |
| 5,180,331 | A * | 1/1993 | Daw et al. | 454/187 |
| 5,461,875 | A | 10/1995 | Lee et al. | |
| 5,673,851 | A * | 10/1997 | Dozier et al. | 236/49.5 |
| 6,010,113 | A | 1/2000 | Rotering | |
| 6,971,631 | B1 | 12/2005 | Naughton | |
| 7,534,167 | B2 * | 5/2009 | Day | 454/187 |
| 2001/0042792 | A1 * | 11/2001 | Kline et al. | 236/49.3 |
| 2005/0208888 | A1 | 9/2005 | Moore et al. | |

FOREIGN PATENT DOCUMENTS

| | | |
|---|---|---|
| DE | 19927265 | 12/1999 |
| WO | WO2005/057065 | 6/2005 |
| WO | WO2005/088204 | 9/2005 |

* cited by examiner

*Primary Examiner* — Steven B McAllister
*Assistant Examiner* — Helena Kosanovic

(57) ABSTRACT

A ventilation system includes a ventilation tile. The ventilation tile has a substantially circular opening to allow air to flow through the ventilation tile and a collapsible damper operable to collapse and expand to alter the size of the substantially circular opening in the ventilation tile and thereby variably restrict air flow through the substantially circular opening.

18 Claims, 8 Drawing Sheets

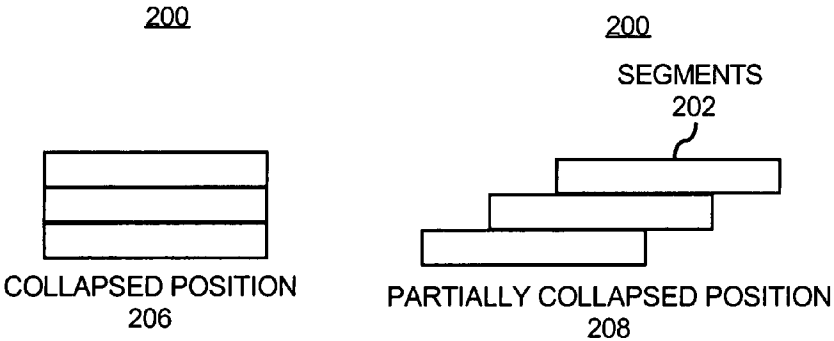
FIG. 2A
FIG. 2B
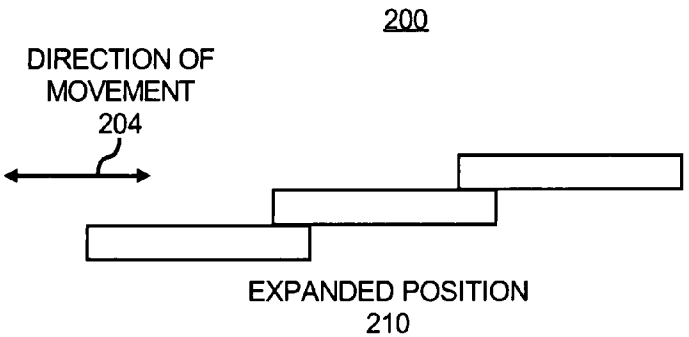
FIG. 2C
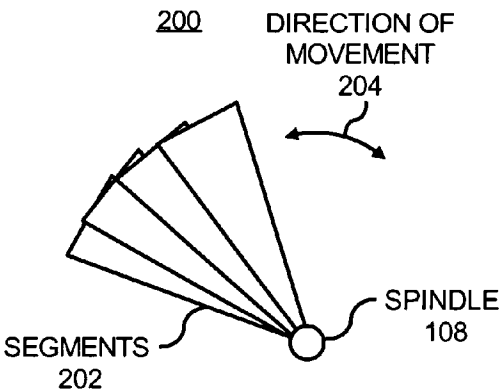
FIG. 2D
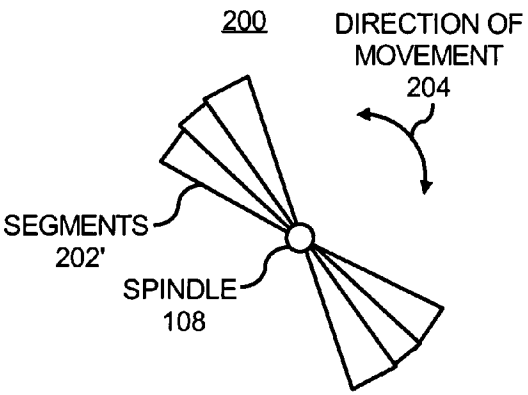
FIG. 2E

VENTILATION TILE WITH COLLAPSIBLE DAMPER

BACKGROUND

Control of cooling air flow delivery in conventional data centers is typically based upon the selection of various floor tiles having patterns created by manufacturers. Oftentimes, conventional floor tiles do not include mechanisms configured to enable varied airflow through the floor tiles. Instead, the floor tiles are configured to provide a substantially fixed volume of cooling air to the racks as designed by the manufacturers. Other types of floor tiles have mechanisms that enable adjustment of cooling air flow through the floor tiles. However, these types of mechanisms are typically manually operated, which require technicians to physically re-position the mechanisms to vary cooling air flow.

In addition, conventional mechanisms for adjusting air flow through ventilation tiles also suffer from an inefficiency caused by the adjusting mechanism blocking the flow of air when in an open position. For example, a conventional ventilation tile uses a plurality of slats where the slats turn 90 degrees to open the vent and allow air to flow through. The presence of the turned slats, in the middle of the air stream, causes a significant amount of blockage, which decreases the effectiveness of the ventilation system. This leads to inefficiencies and wasted energy usage to cool the components housed in the data center, which amounts to increased data center operating costs.

Thus, a need in the art exists for ventilation tiles having mechanisms for adjusting the amount of airflow through ventilation tiles, while substantially reducing the blockage of air when the ventilation tiles are in open positions.

SUMMARY

A ventilation system including a ventilation tile is disclosed. The ventilation tile includes a substantially circular opening to allow air to flow through the ventilation tile and a collapsible damper operable to collapse and expand to alter the size of the substantially circular opening in the ventilation tile and thereby variably restrict air flow through the substantially circular opening.

BRIEF DESCRIPTION OF THE DRAWINGS

Embodiments of the invention are illustrated by way of example and not limitation in the accompanying figures in which like numeral references refer to like elements, and wherein:

FIG. 2A shows a simplified schematic illustration of a collapsible damper in a collapsed position in accordance with a first embodiment;

FIG. 2B shows a simplified illustration of the collapsible damper in a partially collapsed position according to the first embodiment;

FIG. 2C shows a simplified illustration of the collapsible damper in an expanded position according to the first embodiment;

FIG. 2D shows a simplified top view of the collapsible damper in a partially expanded position according to the first embodiment;

FIG. 2E shows a simplified top view of the collapsible damper depicted in FIGS. 2A-2C where the collapsible damper extends the diameter of an opening in a ventilation tile, according to the first embodiment;

DETAILED DESCRIPTION

For simplicity and illustrative purposes, the principles of the invention are described by referring mainly to an example thereof. In the following description, numerous specific details are set forth in order to provide a thorough understanding of the invention. It will be apparent however, to one of ordinary skill in the art, that the invention may be practiced without limitation to these specific details. In other instances, well known methods and structures have not been described in detail so as not to unnecessarily obscure the invention.

The ventilation system described herein comprises a ventilation tile having an opening through which air is allowed to flow to supply airflow to a room. The opening includes a collapsible damper to variably block the opening in the ventilation tile. The collapsible damper may collapse upon itself to allow a substantially large amount of air to flow through the opening when in the collapsed position. In addition, the collapsible damper may expand to substantially fill the opening and substantially block the flow of air through the opening. The collapsible damper may collapse and expand manually or may move under the power of a motor.

The ventilation system may also include sensors to determine the current position of the collapsible damper. In addition, or alternatively, the ventilation system may include sensors to measure environmental conditions, such as air flow, temperature, pressure, humidity, etc. The sensors may be integrated with a controller, such as a computer system, or other computing device, to automatically control the movement of the collapsible damper and thereby control the amount of airflow supplied through the ventilation tile.

Figure 1A:
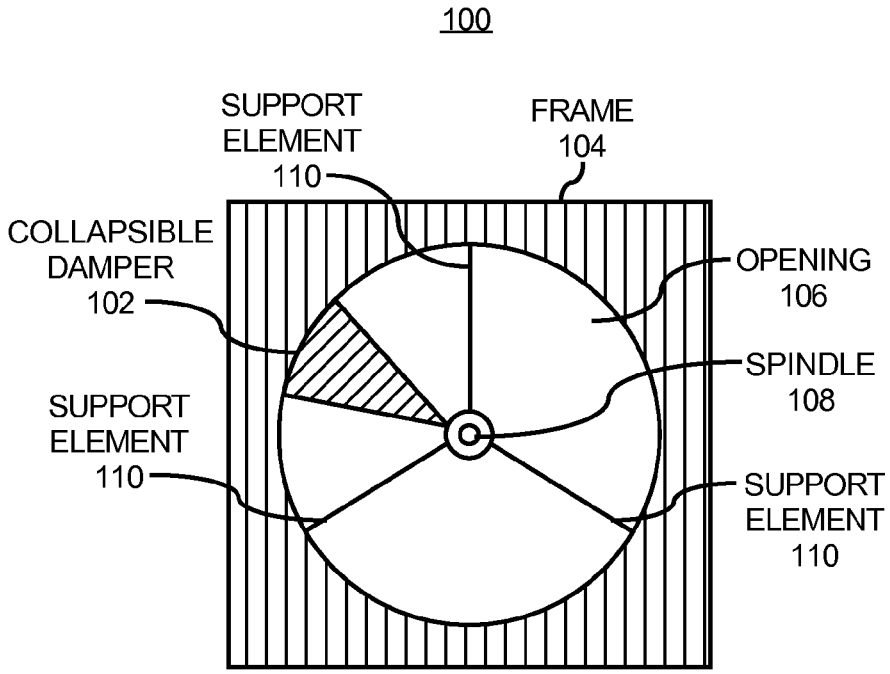
FIG. 1A shows a cross-sectional top view of a ventilation tile according to an embodiment.

With reference first to FIG. 1A, there is shown a cross-sectional top view of a ventilation tile 100, according to an example. It should be understood that the ventilation tile 100 depicted in FIG. 1A is a simplified illustration and that the ventilation tile 100 may include additional components and that some of the components depicted therein may be modified or removed without departing from a scope of the ventilation tile 100.

As shown, the ventilation tile 100 includes a frame 104 and a substantially circular opening 106 formed in the frame 104 that extends through the ventilation tile 100. The frame 104 may comprise any reasonably suitable material including, but not limited to, metal, plastic, composites, paper, wood, etc. In one regard, the ventilation tile 100 may be sized and shaped for use in data centers to enable controllable delivery of airflow into the data centers. In addition, or alternatively, the ventilation tile 100 may be sized and shaped for use in data centers to enable controllable removal of airflow from the data centers.

The ventilation tile 100 includes a collapsible damper 102, which is shown in FIG. 1A as being in a collapsed position. An inner portion of the collapsible damper 102 is depicted as being supported on a spindle 108. The collapsible damper 102 may be rotatably attached to the spindle 108 or the spindle 108 may comprise rotating elements that generally enable the collapsible damper 102 to be rotated about a substantially central axis of the opening 106. By way of example, the spindle 108 may include a guide track or multiple guide tracks to support the inner portion of the collapsible damper 102. In addition, the spindle 108 may be configured to rotate to facilitate the collapse and expansion of the collapsible damper 102.

In any regard, the spindle 108 may be supported to the frame 104 through one or more support elements 110. Although three support elements have been illustrated in FIG. 1A, the ventilation tile 100 may include any reasonably suitable number of support elements 110. The support elements 110 may comprise relatively thin strips of material having sufficient strength to support the spindle 108 and the collapsible damper 102 while being sufficient thin so as to enable air to flow through the opening 106 without being substantially impeded by the support elements 110. In addition, the support elements 110 may comprise any reasonably suitable materials including, but not limited to, metal, plastic, paper, wood, composites, etc.

Figure 1B:
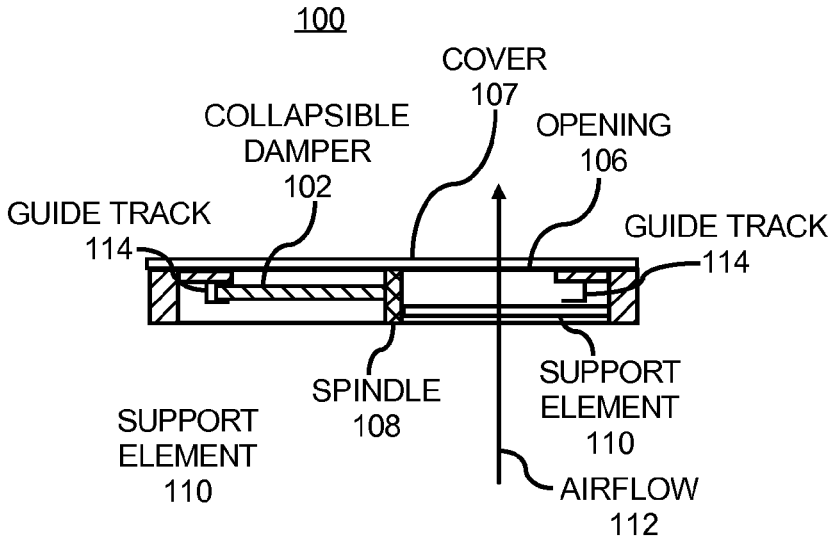
FIG. 1B shows a cross-sectional side view of the ventilation tile depicted in FIG. 1A, according to an embodiment.

With reference now to FIG. 1B, there is illustrated a cross-sectional side view of the ventilation tile 100 depicted in FIG. 1A. As shown, the ventilation tile 100 is depicted as including an optional guide track 114, which is disposed near a periphery of the opening 106. The guide track 114 is considered optional because, in various examples, the collapsible damper 102 may comprise sufficient rigidity to enable the collapsible damper 102 to be cantilevered off from the spindle 108 without requiring that the outer edge of the collapsible damper 102 also be supported.

The guide track 114 is shown as supporting an outer edge of the collapsible damper 102. In addition, the outer edge of the collapsible damper 102 may be supported through any reasonably suitable known manner on the guide track 114. For instance, the outer edge of the collapsible damper 102 may be slidably supported on the guide track 114. As another example, the outer edge of the collapsible damper 102 may be provided with a member configured to rotate along the guide track 114 as the collapsible damper 102 is moved between collapsed and extended positions. In addition, although not shown, the ventilation tile 100 may include multiple guide tracks 114 for supporting multiple collapsible dampers 102 or multiple segments of a collapsible damper 102.

The spindle 108 is also depicted as being supported by the support elements 110. As shown, the support elements 110 may be sized and shaped to substantially prevent interference with the rotation of the collapsible damper 102. In certain instances, such as, when the collapsible damper 102 comprises a sufficiently rigid material or configuration to be supported solely on the guide track 114, the spindle 108 may be considered as being optional.

FIG. 1B also depicts an indication of airflow 112 through the opening 106. The collapsible damper 102 may generally operate to vary the amount of airflow 112 supplied through the ventilation tile 100. Thus, for instance, when the collapsible damper 102 is in a fully collapsed position, the amount of blockage caused by the collapsible damper 102 is substantially minimized. In addition, when the collapsible damper 102 is in a fully expanded position, the amount of blockage caused by the collapsible damper 102 is substantially maximized. In addition, the collapsible damper 102 may be positioned at various positions between the fully collapsed and the fully expanded positions to thereby further control airflow 112 through the ventilation tile 100.

Although the opening 106 of the ventilation tile 100 has been depicted as being uncovered, it should be understood that the opening 106 may include a cover 107, such as, a grating, mesh, etc., to substantially prevent objects from falling through the opening 106 while allowing a majority of the airflow provided through the opening 106 to be supplied out of the opening 106. In addition, the cover may have sufficient strength to support a relatively large amount of weight so as to be suitable for use in data centers.

Figure 1C:
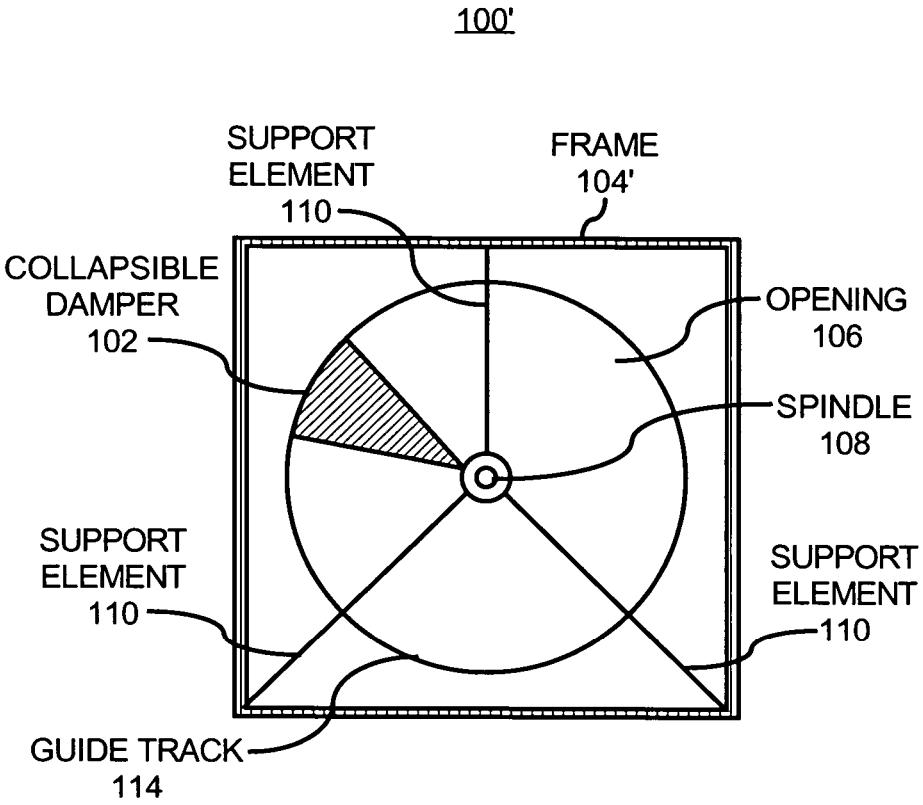
FIG. 1C shows a cross-sectional top view of a ventilation tile according to another embodiment.

With reference now to FIG. 1C, there is shown a cross-sectional top view of a ventilation tile 100', according to a second example. It should be understood that the ventilation tile 100' depicted in FIG. 1A is a simplified illustration and that the ventilation tile 100' may include additional components and that some of the components depicted therein may be modified or removed without departing from a scope of the ventilation tile 100'.

As shown, the ventilation tile 100' depicted in FIG. 1C includes substantially all of the features of the ventilation tile 100 depicted in FIG. 1A. One of the differences, however, is that the frame 104' depicted in FIG. 1C comprises substantially less area than the frame 104 depicted in FIG. 1A. As such, in addition to the opening 106, the space between the optional guide track 114 and the frame 104' is substantially open, to thereby enable relatively larger amounts of airflow to pass through the ventilation tile 100' as compared with the ventilation tile 100. In addition, ventilation tile 100' may enable air to flow through the ventilation tile 100' when the collapsible damper 102 is in the fully expanded condition.

Although the frame 104' has been depicted as being uncovered, the frame 104' may include a cover (not shown), such as, a grating, mesh, movable slats, etc., to substantially prevent objects from falling through the frame 104' while allowing a majority of the airflow provided through the frame 104' to be supplied out of the frame 104'. In addition, the cover may have sufficient strength to support a relatively large amount of weight so as to be suitable for use in data centers.

FIGS. 2A-2D and 3A-3E, respectively illustrate collapsible dampers 200, 300 that are operable to collapse and expand to vary the size of the opening 106 in the ventilation tile 100, according to two examples. It should be understood that the collapsible dampers 200, 300 depicted in FIGS. 2A-2D and 3A-3E are simplified illustrations and that the collapsible dampers 200, 300 may include additional components and that some of the components depicted therein may be modified or removed without departing from scopes of the collapsible dampers 200, 300.

The collapsible dampers 200 and 300 generally comprise configurations that require a relatively small amount of space when in the fully collapsed position and are able to cover a relatively large amount of space when in the fully extended position. With reference first to FIGS. 2A-2C, three possible positions of the collapsible damper 200 is depicted as having a plurality of segments 202 operable to be stacked on top of each other. Therefore, the collapsible damper 200 is in a collapsed positioned 206 when the segments 202 are stacked on top of each other. In addition, the arrow 204 illustrates a direction of movement of the segments.

FIG. 2A illustrates the collapsible damper 200 in a fully collapsed position 206, such as, when the segments 202 are fully stacked on top of each other. When the collapsible damper 200 is in the fully collapsed position 206 a maximum amount of airflow may pass through the opening 106 in the ventilation tile 100. A maximum amount of airflow generally refers to the ability of the ventilation tile 100 to allow a maximum volume of air to pass through the opening 106 without substantially impeding the airflow.

For example, a simple sliding mechanism consisting of parallel plates with holes used in conventional ventilation tiles may impede 50% of the airflow when fully open. Support vanes in conventional ventilation tiles, alone, may impede between 25% and 86% of the airflow. By contrast, examples of the collapsible damper 102, 200, 300 described herein may impede a minimum of approximately 21.5% of the airflow (not including the motor and motor supports). When combined with a 56% open ventilation tile, that is 44% of the tile is covered by support vanes and other materials, 44% of the tile footprint will remain open after installation of the collapsible damper 102, 200, 300, when the collapsible damper is fully collapsed. Therefore, a maximum amount of airflow may be as much as 78.5% of the airflow through an entirely unimpeded opening 106.

FIG. 2B illustrates the collapsible damper 200 in a partially collapsed position 208, such as when the segments 202 are partially stacked on top of each other. In addition, FIG. 2D illustrates a top view of the collapsible damper 200 where the segments 202 are depicted as being rotatable around the spindle 108.

FIG. 2C illustrates the collapsible damper 200 in a fully expanded position 210, such as when the segments 202 have a relatively small amount of overlap with each other. In the fully expanded position 210, the collapsible damper 200 may substantially fill the opening 106 in the ventilation tile 100 to substantially block the flow of air through the opening 106 and allow a minimum amount of airflow through the ventilation tile 100. A minimum amount of airflow may be as low as around 0%, where the collapsible damper 200 is blocking substantially all of the airflow from flowing through the ventilation tile 100.

FIG. 2E illustrates a top view of the collapsible damper 200 according to another example. As shown in FIG. 2E, the segments 202' of the collapsible damper 200 extend on opposite sides of the spindle 108 and have lengths substantially equal to the diameter of the opening 106. Thus, for instance, the collapsible damper 200 depicted in FIG. 2E is capable of closing the opening 106 a twice the speed of the collapsible damper 200 depicted in FIG. 2D. The collapsible damper 200 may additionally have segments that are substantially "X" shaped to generally enable the closure of the opening 106 at four times the speed of the collapsible damper 200 depicted in FIG. 2D. However, there may be an increase in the amount of blockage caused by the collapsible damper 200 when the collapsible damper 200 is in the collapsed position.

Figure 3A:
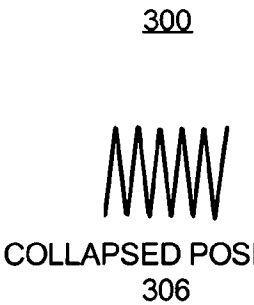
FIG. 3A shows a simplified illustration of a collapsible damper in a collapsed position according to a second embodiment.
Figure 3B:
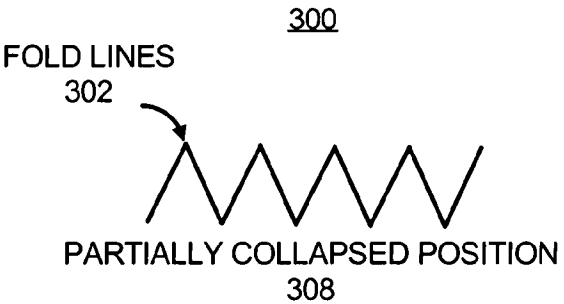
FIG. 3B shows a simplified illustration of a collapsible damper in a partially collapsed position according to the second embodiment.
Figure 3C:
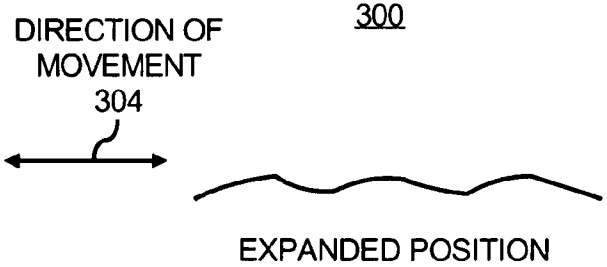
FIG. 3C shows a simplified illustration of a collapsible damper in an expanded position according to the second embodiment.

With reference now to FIGS. 3A-3C, the collapsible damper 300 is depicted as having fold lines 302. The collapsible damper 300 may operate in a manner similar to a Japanese hand-fan or an accordion. The collapsible damper 300 collapses and expands according to similar principles as the bellows of an accordion and, therefore, the movement of the collapsible damper 300 may be described as being accordion-style. In a fully collapsed position 306, shown in FIG. 3A, the collapsible damper 300 is fully folded upon itself and allows a maximum amount of air to flow through the opening 106.

Figure 3D:
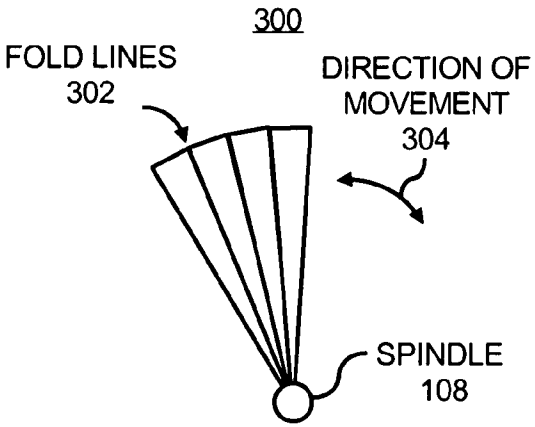
FIG. 3D shows a simplified top view of the collapsible damper in a partially expanded position according to the second embodiment.

The collapsible damper 300 may be moved to a partially collapsed position 308, shown in FIG. 3B, and to a fully expanded position 310 to substantially block the opening 106 in the ventilation tile 100 to allow a minimum amount of air to flow therethrough, as shown in FIG. 3C. In addition, FIG. 3D illustrates a top view of the collapsible damper 300 where the collapsible damper 300 is depicted as being expandable about an axis of the spindle 108.

Figure 4:
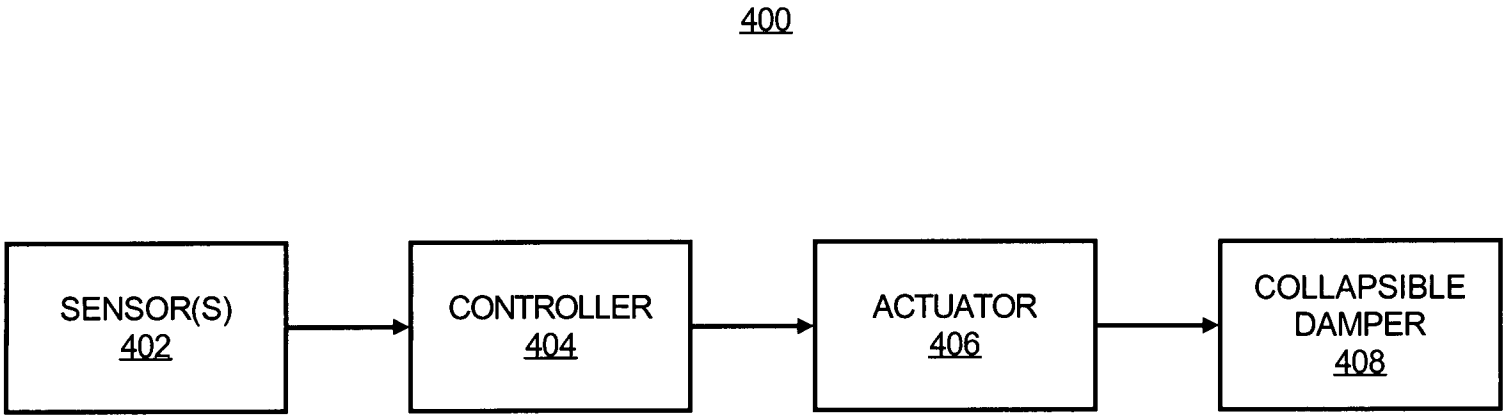
FIG. 4 illustrates a simplified block diagram of a ventilation system, according to an embodiment.

FIG. 4 illustrates a block diagram of ventilation system 400, which may utilize the ventilation tile 100 described above. It should be understood that the ventilation system 400 depicted in FIG. 4 is a simplified illustration and that the ventilation system 400 may include additional components and that some of the components depicted therein may be modified or removed without departing from scope of the ventilation system 400.

The system 400 may include one or more sensors 402. The one or more sensors 402 used in the ventilation system 400 may be similar to those described in copending and commonly assigned U.S. patent application Ser. No. 10/799,730, filed on Mar. 15, 2004, which is hereby incorporated by reference in its entirety. In this regard, for instance, the one or more sensors 402 may comprise one or more sensors for determining a position of the collapsible damper 102, 200, 300. Thus, by way of example, the one or more sensors 402 may be employed to determine the level to which the opening 106 is blocked by the collapsible damper 102, 200, 300, and to thereby calculate the level of airflow supplied through the opening 106 in the ventilation tile 100.

The one or more sensors 402 may also include instruments for detecting at least one environmental condition, such as air flow, temperature, humidity, etc. In this example, the one or more sensors 402 may be positioned to detect the at least one environmental condition at various locations with respect to the ventilation tile 100. For instance, the one or more sensors 402 may be positioned to detect condition(s) near the ventilation tile 100, condition(s) of one or more objects positioned to receive airflow from the ventilation tile 100, etc.

In any regard, readings from the one or more sensors 402 may be transmitted to a controller 404. The controller 304 may comprise a computing device operable to receive input and determine if a collapsible damper 102 is in an appropriate position. The controller 404 may be similar to the controller described in U.S. patent application Ser. No. 10/799,730.

In one example, the controller 404 may determine if a collapsible damper 102 is in a desired position by comparing the current position of the collapsible damper 102 to a desired target position of the collapsible damper 102. A target position of the collapsible damper 102 may be a position which allows a particular amount of air flow through the opening 106 in the ventilation tile 100. The target position may be determined, for instance, by analyzing conditions, such as temperature, humidity, airflow, etc., of a particular region of a room. In addition, the analyzed conditions may be compared to desired conditions. If the analyzed conditions differ from the desired conditions, then the position of the collapsible damper 102, 200, 300 may be altered to a target position to render the analyzed conditions in congruence with the desired conditions.

If the controller 404 determines that the collapsible damper 102 requires movement to another position to achieve the target position, the controller 404 may transmit an instruction to an actuator 406. The actuator 406 may comprise a motor or other similar device having the ability to alter the position of the collapsible damper 102. Examples of suitable devices are described in U.S. patent application Ser. No. 10/799,730. For example, the actuator 406 may include a motor in connection with the spindle 108 of the ventilation tile 100. In this example, when an instruction is received from the controller 404, the actuator 406 may rotate the spindle 108, thereby causing the collapsible damper 408, which may comprise any of the previously described collapsible dampers 102, 200, 300 to rotate and vary the size of the opening 106.

As another example, the actuator 406 may comprise a motor configured to rotate the collapsible damper 408 through movement other than through rotation of the spindle 108. In this example, the actuator 406 may be directly connected to the collapsible damper 408 and may thus directly cause the collapsible damper 408 to expand and collapse.

Figure 5A:
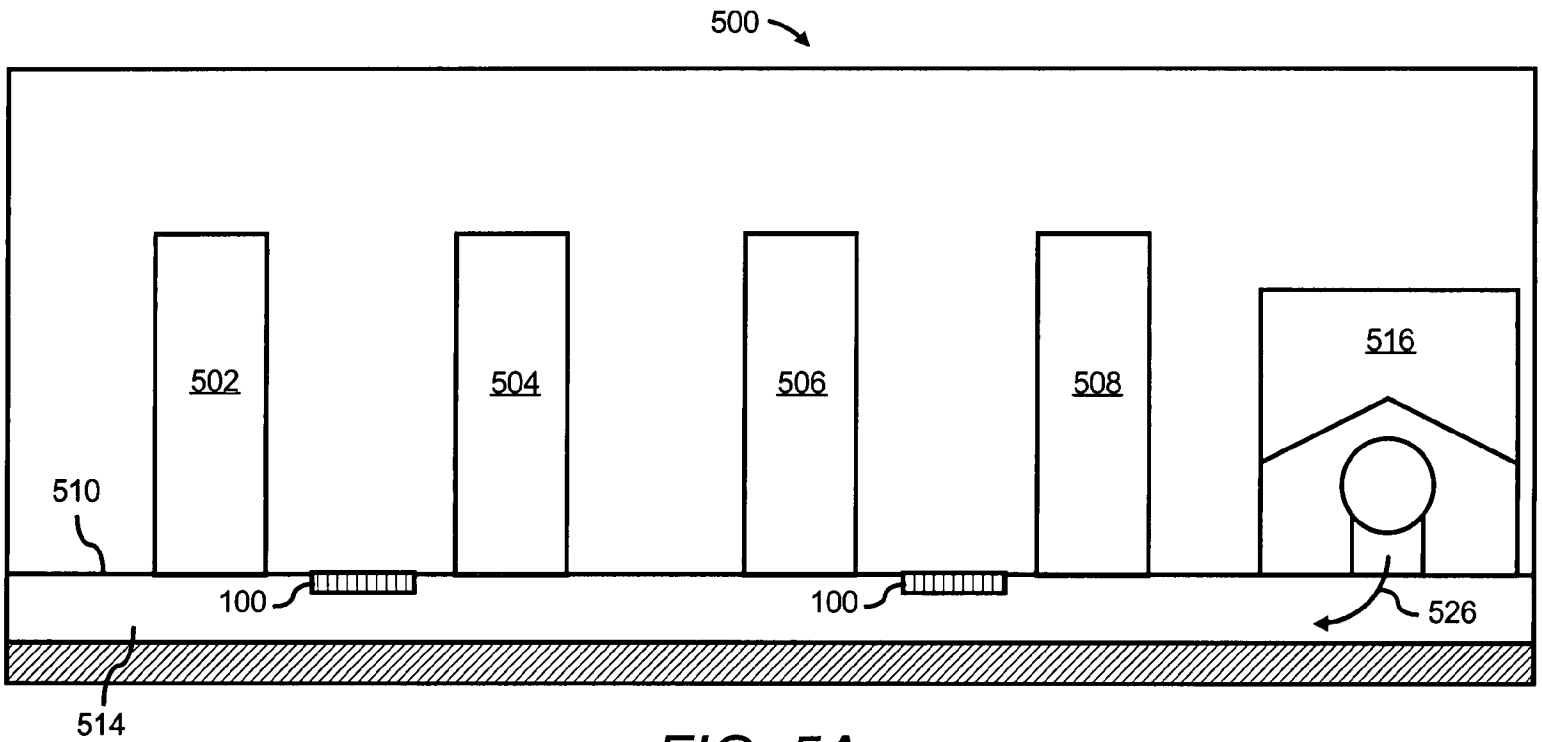
FIG. 5A shows a simplified schematic illustration of a room and cooling system, according to an embodiment.

FIG. 5A, shows a simplified schematic illustration of a room 500 and cooling system, which employs the ventilation tile 100, according to an example. It should be understood that the room 500 depicted in FIG. 5A is a simplified illustration and that the room 500 may include additional components and that some of the components depicted therein may be modified or removed without departing from a scope of the room 500.

The room 500 is depicted as having a plurality of racks 502-508, which may include electronics cabinets. Although not visible in FIG. 5A, the racks 502-508 may comprise end racks in respective rows of racks. That is, additional racks (not shown) may be located adjacent to the racks 502-508 to form rows of racks. The racks 502-508 may be positioned on a raised floor 510. The space below the floor 510 may function as a plenum 514 for delivery of cooling air from an air conditioning unit 516. The cooling air may be delivered from the plenum 514 to the racks 502-508 through ventilation tiles 100 located between some or all of the racks 502-508.

The racks 502-508 are generally configured to house a plurality of electronic components, for instance, networking equipment, storage drives, processors, micro-controllers, high-speed video cards, memories, semi-conductor devices, and the like. The components may be elements of a plurality of subsystems (not shown), for instance, computers, servers, etc. The subsystems and the components may be implemented to perform various electronic, for instance, computing, switching, routing, displaying, and the like, functions. In the performance of these electronic functions, the components, and therefore the subsystems, may generally dissipate relatively large amounts of heat. To remove the heat generated by these electronic components, cooling airflow may be supplied through the ventilation tiles 100. In addition, the heated airflow may be supplied into the air conditioning unit 516, which operates to cool the heated airflow.

In addition, the air conditioning unit 516 supplies the racks 502-508 with air that has been cooled in any reasonably suitable known manner, for instance, as disclosed in commonly assigned U.S. Pat. No. 6,574,104, the disclosure of which is hereby incorporated by reference in its entirety. The air conditioning unit 516 supplies cooling airflow into the plenum 514 as also disclosed in the U.S. Pat. No. 6,574,104.

In operation, cooling air generally flows into the plenum 514 as indicated by the arrow 526. The cooling air flows out of the raised floor 510 and into various areas of the racks 502-508 through the ventilation tiles 100. The amount of cooling air supplied through the ventilation tiles 100 may be varied, for instance, according to the heat generated in the racks 502-508. Accordingly, the opening 106 in the ventilation tiles 100 may be adjusted to vary the volume flow rate of air supplied to the room 500, in manners as described herein above.

The air conditioning unit 516 may also vary the amount of cooling air supplied to the plenum 514, as the cooling requirements vary according to the heat loads in the racks 502-508, along with the subsequent variations in the volume flow rate of the cooling air. As an example, if the heat loads in the racks 502-508 generally increases, the air conditioning unit 516 may operate to increase the supply and/or decrease the temperature of the cooling air delivered into the plenum 514. Alternatively, if the heat loads in the racks 502-508 generally decrease, the air conditioning unit 516 may operate to decrease the supply and/or increase temperature of the cooling air. In this regard, the amount of energy utilized by the air conditioning unit 516 to generally maintain the components in the room 500 within predetermined operating temperature ranges may substantially be optimized.

Through operation of the ventilation tiles 100 and the air conditioning unit 516, global and zonal control of the cooling air flow and temperature may be achieved. For instance, the ventilation tiles 100 generally provide localized or zonal control of the cooling air flow to the racks 502-508. In addition, the air conditioning unit 516 generally provides global control of the cooling air flow and temperature throughout various portions of the room 500. By virtue of the zonal and global control of the cooling air, the amount of energy consumed by the air conditioning unit 516 in maintaining the components of the racks 502-508 within predetermined operating temperature ranges may substantially be reduced in comparison with conventional room cooling systems.

Zonal control may be achieved with one or more sensor 402 for detecting one or more conditions in the room 500. The detected conditions may include, for example, sounds, images, environmental conditions, such as temperature, pressure, air flow, humidity, location, etc. The one or more sensors 402 may be located in any reasonably suitable location throughout the room 500. Information from the one or more sensor 402 may be transmitted to a controller 404, as described with respect to FIG. 4 above. The controller 404 may include an output to display information obtained from the one or more sensors 402 to a user. A user may utilize the information displayed by the controller to determine if ventilation tiles 100 in particular locations require altering to modify the volume flow rate of airflow supplied through the ventilation tiles 100.

In addition, or alternatively, the ventilation system 400 may operate in a substantially automatic manner. That is, for instance, the controller 404 may receive information from the one or more sensors 402 and may determine if more or less air is needed in particular locations. The controller 404 may then automatically alter the positions of collapsible dampers 102, 200, 300, as required to achieve a desired zonal climate.

Figure 5B:
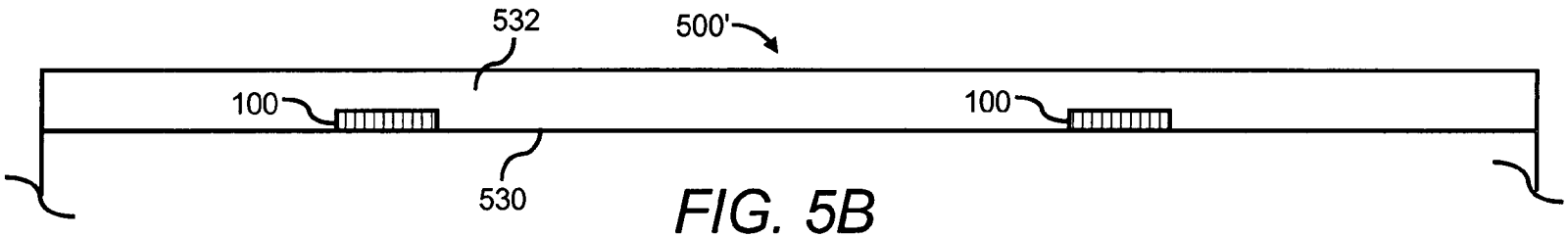
FIG. 5B shows a schematic illustration of a top portion of a room according to another embodiment.

FIG. 5B illustrates a top portion of the room 500' according to another example. The room 500' may be identical to the room 500 except that the room 500' includes a lowered ceiling 530 on which are located ventilation tiles 100. In this example, the ventilation tiles 100 may be configured to supply cooling airflow from a plenum 532 formed by the lowered ceiling 530. In addition, or alternatively, the ventilation tiles 100 may be employed to control the exhaust of heated airflow from the room 500'.

Figure 6:
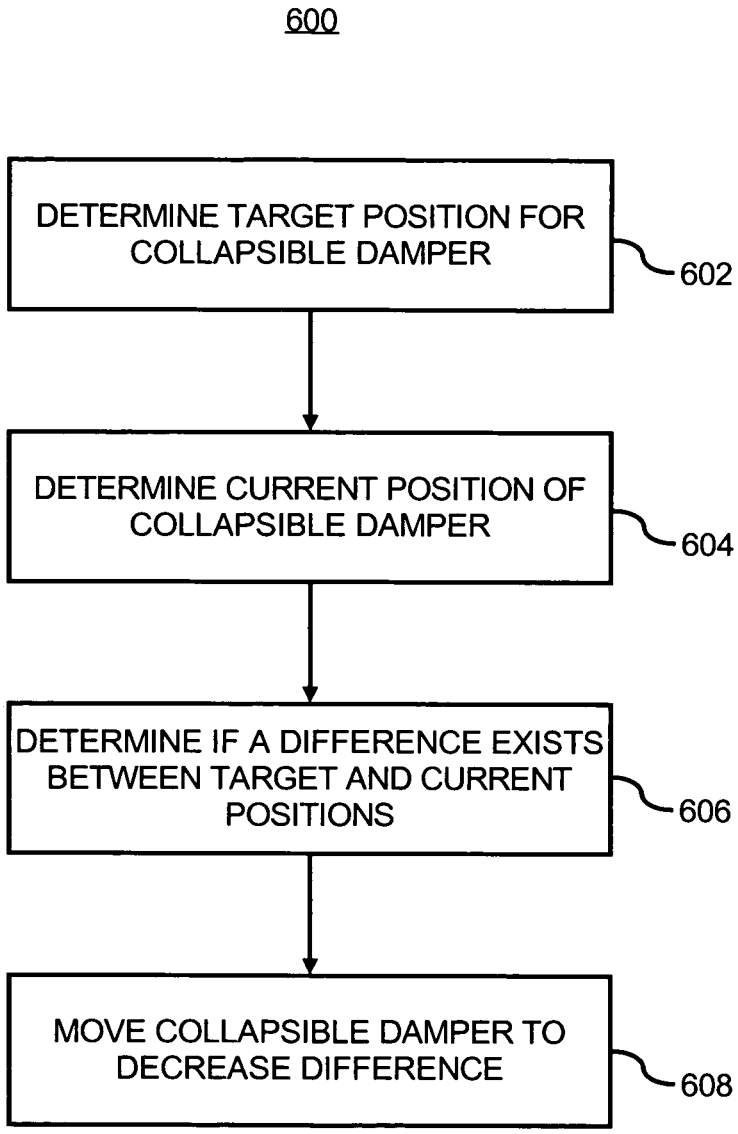
FIG. 6 shows a flow diagram of a method according to an embodiment.

FIG. 6 shows a flow diagram of a method 600 in which the position of the collapsible damper 602 may be altered, according to an example. It is to be understood that the following description of the method 600 is but one manner of a variety of different manners in which the position of the collapsible damper 102 may be altered. It should also be apparent to those of ordinary skill in the art that the method 600 represents a generalized illustration and that other steps may be added or existing steps may be removed, modified or rearranged without departing from the scope of the method 600.

The method 600 may be initiated at step 602 by determining a target position for a collapsible damper 102, 200, 300. The target position for a collapsible damper 102, 200, 300 may be determined by a controller 404 based upon, for instance, a sensor reading indicating a variation in the cooling air flow requirement in an area associated with a ventilation tile 100. For instance, the target position may be selected to increase the size of the opening 106 in a ventilation tile 100 to thereby increase the airflow volume delivered to the associated area of a room 500, if the detected temperature in that area is above a predetermined temperature range. Alternatively, the target position may be selected to decrease the size of the opening 106 to thereby decrease the airflow volume delivered to the associated area if detected temperatures in that area are below the predetermined temperature range.

Although the target position selection has been described as being based upon temperature, other considerations may be employed in determining the target position. For instance, the target position may be selected according other detected environmental conditions, such as, humidity, pressure, air re-circulation, etc., or anticipated workloads by the components in the room 500.

At step 604, the current position of the collapsible damper 102, 200, 300 may be detected through implementation of the one or more sensors 402 in any of the manners described herein above. The current position information obtained by the one or more sensors 402 may be communicated to the controller 404, as also described herein above. The controller 404 may compare the current position to the target position to determine whether the collapsible damper 102, 200, 300 requires manipulation. Therefore, the controller 404 may determine whether the current position substantially equals the target position at step 606. If the current position substantially equals the target position, for instance, within a degree of error, the method 600 may end since the collapsible damper 102 is in the desired position.

If the current position does not equal the target position, the controller 404 may instruct the actuator 406 to alter the current position of the collapsible damper 102, 200, 300 until the position of the collapsible damper 102, 200, 300 substantially equals the target position, as indicated at step 608.

In another example, the controller 404 may be configured to determine the length of time the actuator 406 is to be supplied with power to enable the collapsible damper 102, 200, 300 to reach the target position. In this case, the controller 404 may implement an algorithm designed to calculate, based upon the speed of the actuator 406 and the distance the collapsible damper 102, 200, 300 is to travel, the length of time power is to be supplied to the actuator 406. In addition, under this example, constant detection of the current position may not be required and detection of the current position may be performed to substantially ensure that the collapsible damper 102, 200, 300 is in the desired position.

The steps illustrated in the method 600 may be contained as a utility, program, subprogram, in any desired computer accessible medium. In addition, the method 600 may be embodied by a computer program, which can exist in a variety of forms both active and inactive. For example, they can exist as software program(s) comprised of program instructions in source code, object code, executable code or other formats. Any of the above can be embodied on a computer readable medium, which include storage devices and signals, in compressed or uncompressed form.

Examples of suitable computer readable storage devices include conventional computer system RAM (random access memory), ROM (read only memory), EPROM (erasable, programmable ROM), EEPROM (electrically erasable, programmable ROM), and magnetic or optical disks or tapes. Examples of computer readable signals, whether modulated using a carrier or not, are signals that a computer system hosting or running the computer program can be configured to access, including signals downloaded through the Internet or other networks. Concrete examples of the foregoing include distribution of the programs on a CD ROM or via Internet download. In a sense, the Internet itself, as an abstract entity, is a computer readable medium. The same is true of computer networks in general. It is therefore to be understood that those functions enumerated below may be performed by any electronic device capable of executing the above-described functions.

Figure 7:
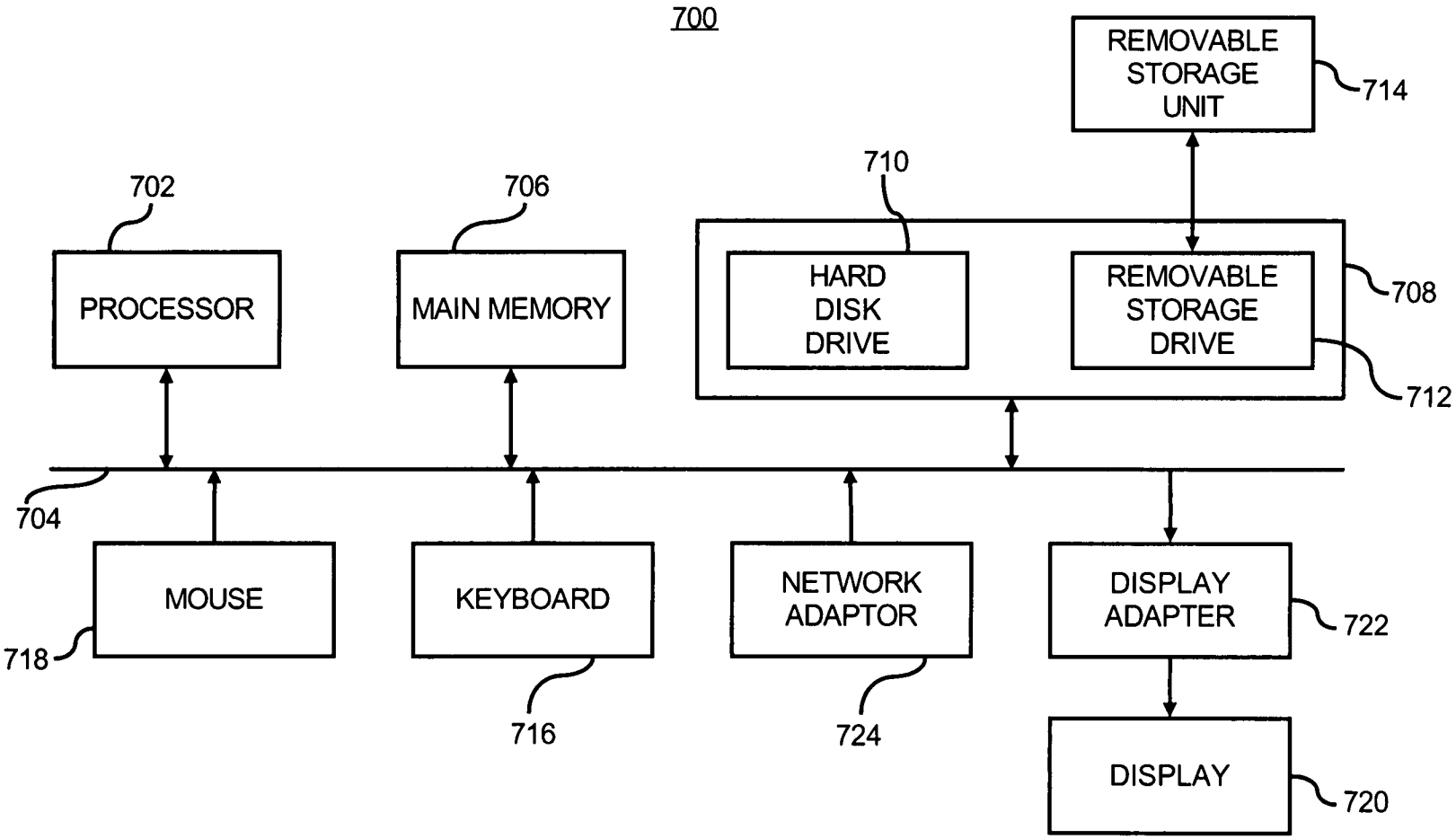
FIG. 7 illustrates an exemplary computer system, which may be implemented to perform various functions described herein, according to an embodiment.

FIG. 7 illustrates a computer system 700, which may be employed to perform the various functions of the controller 404, according to an embodiment of the invention. The computer system 700 may be used as a platform for executing one or more of the functions described hereinabove with respect to the various components of the controller 404.

The computer system 700 includes a processor 702, which may be used to execute some or all of the steps described in the method 600. Commands and data from the processor 702 are communicated over a communication bus 704. The computer system 700 also includes a main memory 706, such as a random access memory (RAM), where the program code for, for instance, the controller 404, may be executed during runtime, and a secondary memory 708. The secondary memory 708 includes, for example, one or more hard disk drives 710 and/or a removable storage drive 712, representing a floppy diskette drive, a magnetic tape drive, a compact disk drive, etc., where a copy of a program code may be stored.

The removable storage drive 710 reads from and/or writes to a removable storage unit 714 in a well-known manner. User input and output devices may include a keyboard 716, a mouse 718, and a display 720. A display adaptor 722 may interface with the communication bus 704 and the display 720 and may receive display data from the processor 702 and convert the display data into display commands for the display 720. In addition, the processor 702 may communicate over a network, e.g., the Internet, LAN, etc., through a network adaptor 724.

It will be apparent to one of ordinary skill in the art that other known electronic components may be added or substituted in the computer system 700. In addition, the computer system 700 may include a system board or blade used in a rack in a data center, a conventional "white box" server or computing device, etc. Also, one or more of the components in FIG. 7 may be optional (for instance, user input devices, secondary memory, etc.).

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which intended to be defined by the following claims—and their equivalents—in which all terms are meant in their broadest reasonable sense unless otherwise indicated.

What is claimed is:

1. A ventilation system comprising:

a ventilation tile having, a frame sized for placement as a modular floor tile on a raised floor of a data center, a substantially circular opening in the frame to allow air to flow through the ventilation tile;

a collapsible damper formed of a sheet of material having fold lines operable to collapse and expand into various folded positions to alter the size of the substantially circular opening in the ventilation tile and thereby variably restrict air flow through the substantially circular opening;

a guide track supporting an outer edge of the collapsible damper;

a cover positioned on the frame to protect the collapsible damper from physical damage;

a sensor;

an actuator for manipulating the collapsible damper; and a controller configured to receive a condition detected by the sensor and to manipulate the actuator based upon the received condition detected by the sensor.

2. The ventilation system of claim 1, wherein the sheet of material is configured to rotate around a substantially central location of the substantially circular opening to move between a fully collapsed position and a fully expanded position.

3. The ventilation system of claim 2, wherein a minimum amount of air flows through the opening in the ventilation tile when the collapsible damper is in the fully expanded position and a maximum amount of air flows through the opening in the ventilation tile when the collapsible damper is in the fully collapsed position.

4. The ventilation system of claim 2, wherein the sheet of material is divided into multiple segments between the fold lines operable to stack on top of each other as the collapsible damper is moved to the fully collapsed position.

5. The ventilation system of claim 4, wherein the multiple segments are sized to extend approximately the diameter of the substantially circular opening.

6. The ventilation system of claim 2, wherein the fold lines enable the collapsible damper to expand and collapse as the collapsible damper is rotated around the substantially central location of the substantially circular opening.

7. The ventilation system of claim 2, further comprising:

a spindle located around the substantially central location of the substantially circular opening, wherein the collapsible damper is attached to the spindle.

8. The ventilation system of claim 7, wherein the actuator is configured to rotate the spindle to thereby cause the collapsible damper to be rotated around the substantially central location of the substantially circular opening.

9. The ventilation system of claim 7, further comprising:

at least one support element configured to support the spindle at the substantially central location of the substantially circular opening.

10. The ventilation system of claim 2, wherein the at least one guide track is disposed around a periphery of the substantially circular opening, wherein the at least one guide track enables the collapsible damper to be moved between the fully collapsed position and the fully expanded position.

11. The ventilation system of claim 1, wherein the sensor comprises a sensor for determining the position of the collapsible damper, and wherein the controller is configured to manipulate the collapsible damper in response to the position of the damper determined by the sensor.

12. The ventilation system of claim 1, wherein the sensor comprises a sensor for detecting one or more environmental conditions, and wherein the controller is configured to manipulate the collapsible damper in response to the one or more environmental conditions detected by the sensor.

13. A room comprising:

a raised floor having a plurality of modular floor tiles and an opening;

a plenum positioned beneath the opening in the raised floor a ventilation tile positioned within the opening, wherein the ventilation tile comprises a size similar to the plurality of modular floor tiles, and wherein the ventilation tile includes a substantially circular opening, a collapsible damper formed of a sheet of material having fold lines operable to collapse and expand into various folded positions to variably restrict air flow through the substantially circular opening in the ventilation tile, a guide track supporting an outer edge of the collapsible damper, and a cover positioned to protect the collapsible damper;

at least one sensor;

an actuator configured to manipulate the collapsible damper; and a controller configured to manipulate the actuator based upon a condition detected by the at least one sensor.

14. The room of claim 13, wherein the at least one sensor comprises a sensor for determining a position of the collapsible damper, and wherein the controller is configured to control the actuator to manipulate the collapsible damper into desired positions.

15. The room of claim 13, wherein the at least one sensor comprises a sensor for detecting one or more environmental conditions, and wherein the controller is configured to control the actuator to manipulate the collapsible damper to maintain one or more environmental conditions within predetermined ranges.

16. A method for controlling airflow through a ventilation system, said ventilation system including a ventilation tile having a substantially circular opening, a collapsible damper formed of a sheet of material having fold lines operable to collapse and expand into various folded positions to vary the size of an opening in the ventilation tile, a cover positioned on the frame to protect the collapsible damper, a guide track supporting an outer edge of the collapsible damper, and an actuator configured to move the collapsible damper, the method comprising:

placing the ventilation tile in an opening of a raised floor, wherein the opening is sized to receive a modular floor tile and wherein the ventilation tile comprises a size similar to a modular floor tile;

determining a target position for the collapsible damper;

determining a current position of the collapsible damper;

determining if a difference exists between the current position of the collapsible damper and the target position for the collapsible damper; and moving the collapsible damper between various folded positions to decrease a difference between the current position of the collapsible damper and the target position of the collapsible damper.

17. The method according to claim 16, wherein the collapsible damper is operable to collapse and expand and wherein moving the collapsible damper to decrease the difference further comprises at least one of:

collapsing the collapsible damper to allow air to flow through the opening in the ventilation tile; and expanding the collapsible damper by rotating the collapsible damper around a substantially central location of the substantially circular opening to reduce an amount of air flow through the opening.

18. The method of claim 17, wherein the collapsible damper sheet of material is divided into multiple segments between the fold lines and wherein moving the collapsible damper to decrease any difference comprises:

moving the segments between various stacked positions to vary the size of the substantially circular opening in the ventilation tile.

* * * * *